United States Patent [19]

Spangenberg

[11] Patent Number: 4,723,586

[45] Date of Patent: Feb. 9, 1988

[54] VENETIAN BLIND

[75] Inventor: Robbert E. Spangenberg, Oosterhout, Netherlands

[73] Assignee: Hunter Douglas International N.V., Curacao, Netherlands

[21] Appl. No.: 797,577

[22] Filed: Nov. 13, 1985

[30] Foreign Application Priority Data

Dec. 12, 1984 [EP] European Pat. Off. ..... 84308624.0

[51] Int. Cl.[4] ..... E06B 9/264

[52] U.S. Cl. ..... 160/107; 160/176 R

[58] Field of Search ..... 160/107, 174, 176 R, 160/168 R, 166 A, 166 R, 178 R, 178 B, 172

[56] References Cited

U.S. PATENT DOCUMENTS

| | | | |
|---|---|---|---|
| 1,889,226 | 11/1932 | Steffen | 160/176 X |
| 3,129,471 | 4/1964 | Johnson et al. | 160/107 X |
| 3,269,453 | 8/1966 | Vecchiarelli et al. | 160/176 |
| 3,389,737 | 6/1968 | Arnold et al. | 160/107 |
| 3,722,572 | 3/1973 | Hall | 160/107 |
| 4,458,740 | 7/1984 | Anderson | 160/107 X |
| 4,480,674 | 11/1984 | Anderson | 160/107 |
| 4,484,611 | 11/1984 | Anderson | 160/107 |
| 4,493,357 | 1/1985 | Anderson | 160/107 X |

*Primary Examiner*—Ramon S. Britts
*Assistant Examiner*—David M. Purol
*Attorney, Agent, or Firm*—Pennie & Edmonds

[57] ABSTRACT

A venetian blind suitable for mounting in a space between two panes (16,17) of a multiple glazed window assembly (16,17) and comprising upper and lower supporting members (31, 32) between which are mounted the slat supporting means, such as a ladder tape. The supporting member (31,32) carries drive members (47) which are positively driven by a flexible drive element (55), which in turn is driven by an actuating member (58,59) located between the panes (16,17) and an operating element (68) is mounted outside the inner pane (17). The upper and lower supporting members (31,32) are mounted on supporting clips (25) which are held in place by being pushed fitted into upper and lower carriers (14,15) carried by the upper and lower window frame parts (12,13).

18 Claims, 11 Drawing Figures

VENETIAN BLIND

DESCRIPTION

The present invention relates to a venetian blind suitable for mounting in the space between the panes of a multiple glazed window assembly.

Various designs have been proposed for mounting a venetian blind between the two panes of a double, triple or multiple glazed window (hereinafter referred to collectively as a multiple glazed window assembly), and have been capable of being operated exteriorly. Normally these blinds are not capable of being raised and lowered, but one has the ability to alter the tilt angle of the slats to give more or less illumination. The controls which have been proposed include cords which pass through the frame and magnetic means have also been proposed, having an operating element outside the window and an actuating element inside the window which usually operates on one of the supporting members of the blind which is located at the top or bottom and carries the supporting means, which may be, for example, be in the form of a ladder cord or tape arrangement. One such design is, for example, illustrated in U.S. Pat. No. 2,631,339. In this the control of the blind is effected by a knob which is turned and causes a pinion to rotate which operates a rack which tilts the upper and lower supporting members. However, this is a very cumbersome and complex arrangement.

An example of the blind using a magnetically of the operated acuating member within the blind is illustrated in, for example, in European Patent Application published under No. 0082723.

These blinds can work reasonably satisfactorily but they all have the difficulty, when mounted in a sealed multiple glazed window assembly, of there being some considerable inconsistency in the amount by which the various slats of the blind tilt and the blinds have proved to be not very robust.

The present invention, therefore, relates to a venetian blind suitable for mounting in a space between two panes of a multiple glazed window assembly, of the general type comprising upper and lower elongate supporting members extending across all or part of the width of the blind, means for pivotably mounting said supporting members about their longitudinal axes on the frame of the window assembly, slat supporting means extending between and supported by said upper and lower supporting members, a plurality of slats carried by said slat supporting means and operating means operable from the exterior of the window assembly.

The invention resides in the facts that the upper and lower supporting members are provided with respectively an upper and lower drive member, in that a flexible drive element is positively connected to said upper and lower drive members in a position to extend in a space between the panes of the window assembly, and in that the operating means are operable on said flexible drive element to cause said upper and lower supporting members to be positively tilted together without any slippage or relative movement between said supporting members and said flexible drive element thereby to cause tilting of said slats, so that the tilting forces are transferred from the operating means to said upper and lower supporting members solely by said flexible drive element and said upper and lower drive members.

Such a structure positively controls the movement of the upper and lower supporting members due to the action of the flexible drive element and one does not have to rely on the forces being transmitted by the slat supporting means, such as a ladder tape, to effect the tilting at all. The tilting of the slats is brought about by the tilting of the supporting members which in turn is brought about by the movement of the flexible drive element.

The upper and lower drive members are preferably provided with at least partly circular surfaces over which the flexible drive element passes and means are provided to positively engage the flexible drive element on said at least partly circular surfaces. By having such part circular surfaces, the drive element is always positioned in the same vertical plane, so that it can be actuated on very readily by a linearly movable actuating member. One particular form of such actuating member carries a magnet, whereby the actuating member can be moved by an operating member on the opposite side of the pane of glass, said operating member either being a further magnet or a member carrying a further magnet. Advantageously the actuating member is movable in a guide, mountable on the inside of a vertical part of the window frame, to control accurately the movement of the actuating member and said guide having means to hold the magnet carried thereby in contact with the adjacent pane. The flexible drive element may be adjustably secured to the actuating member to enable the drive element to be mounted with a preselected tensioning force.

The flexible drive element is preferably in the form of a metal band provided with at least one aperture or projection in the portion thereof passing over each at least partly circular surface, said surface being provided with projections or recesses to engage with said apertures or projections respectively. This interengagement of the apertures and projections is a simple way of providing the positive connection between the drive element and the drive members, so that there is no slippage therebetween.

The drive members may be formed integrally with the upper and lower supporting elements, but preferably they are formed separately and at least one of the drive members is angularly adjustable with respect to its associated supporting member in a plane perpendicular to the longitudinal axis of the supporting member.

This may be achieved by having at least one of the drive members formed in two parts, a first part having said at least partly circular surface thereon and the second part being connected to the supporting member, the first part being circumferentially adjustable relative to the second part.

At least one of the slat supporting means, for example a ladder tape, may be secured to a supporting member by a plate fixedly connected to that supporting member. This plate can be used simply to clamp the ends of the supporting means to the supporting member.

Adjacent each plate, the associated supporting member may be provided with an opening, the means for pivotably mounting said associated supporting member having a through bore therein, and these means may be pivotably mounted in said opening by way of a bearing pin passing through said through bore and into an opening in said plate.

Thus the plate may be used not only to hold the slat supporting means but may also be used for the mounting of the bearing pin of the pivotable mount for the supporting member.

According to another aspect of the invention there is provided a venetian blind of the general type referred to in which the means for pivotably mounting the supporting members comprise bearing clips, which each include a securing element which is engageable by a snap-fit connection in the receiving portion of a carrier securable to, integral with, or forming the respective upper and/or lower window frame of the window assembly. For example, the carrier may comprise an elongate profile of constant cross-section having a continuous receiving channel, with inturned rims and into which said securing element may be pushed, the head of said securing element snap-fitting behind said rims. Such an arrangement allows easy assembling of the complete blind within the window frame either during manufacture of the original multiple glazed window assembly or in the subsequent fitting of a venetian blind to an existing window assembly.

In order that the present invention may more readily be understood, the following description is given, merely by way of example, reference being made to the accompanying drawings, in which.

Figure 1:
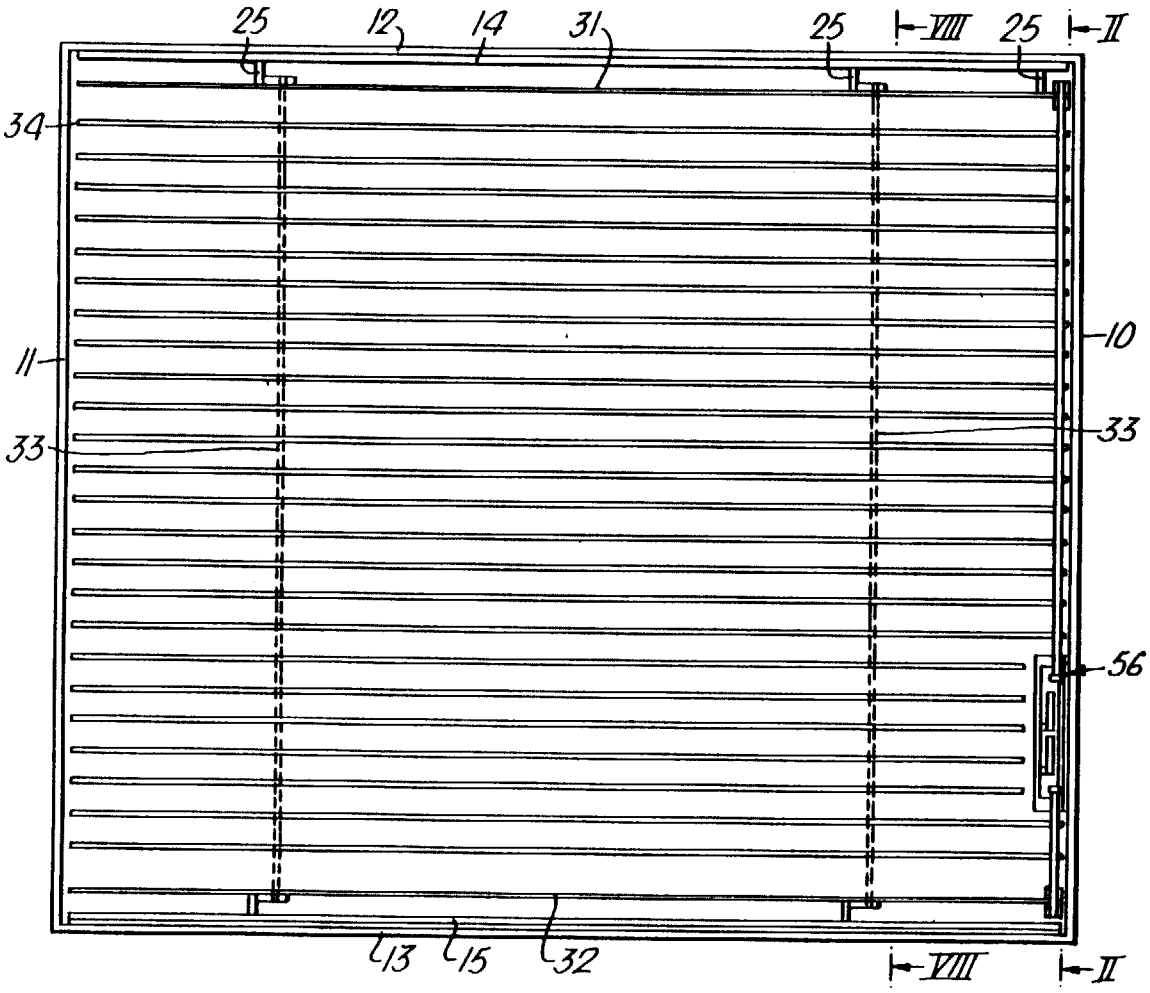
FIG. 1 is a schematic front elevation of one emobodiment of multiple glazed window assembly including a venetian blind according to the present invention.
Figure 7:
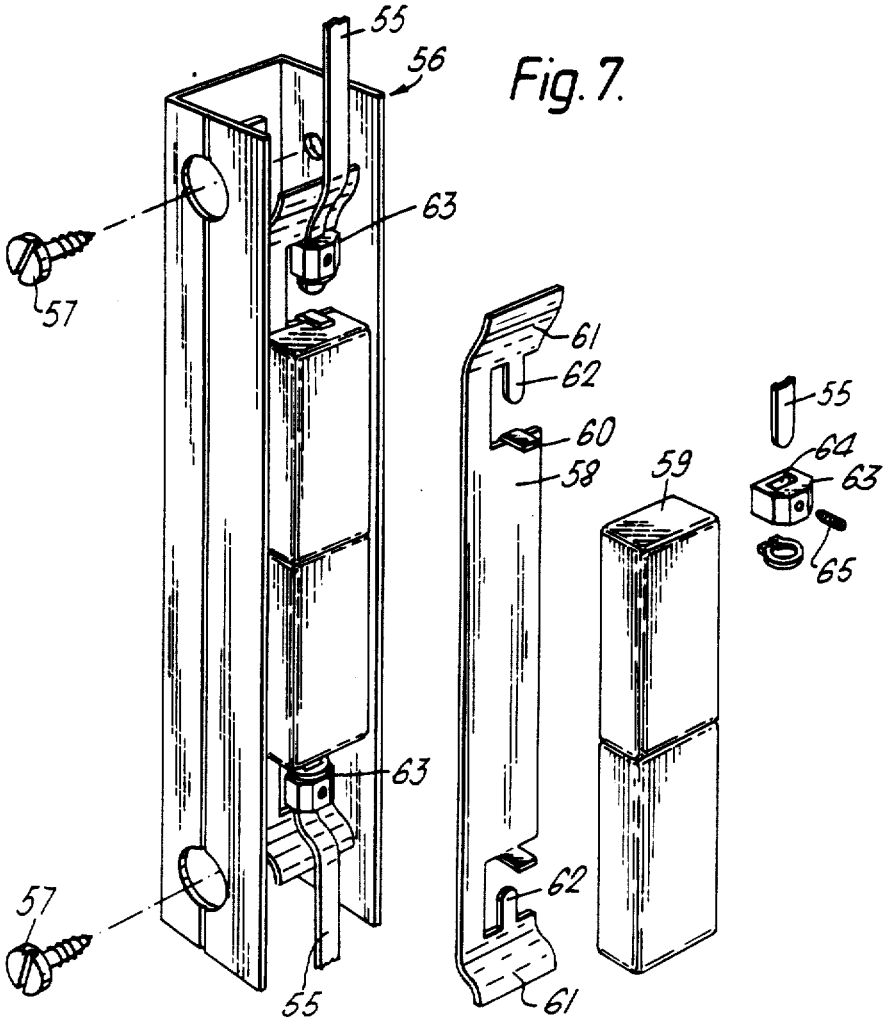
Figure 8:
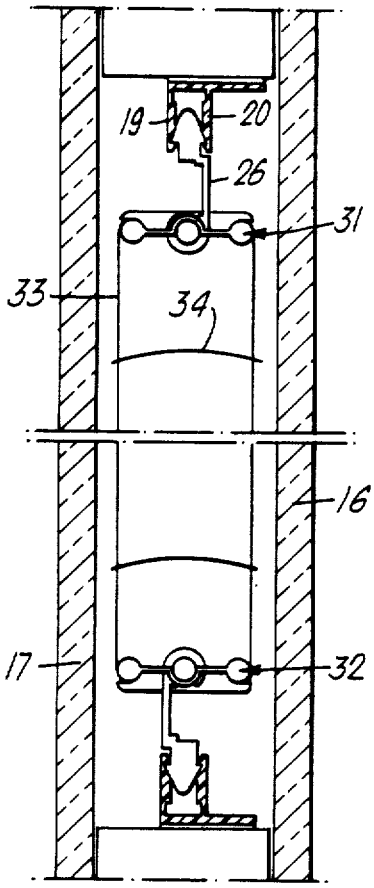
Figure 9:
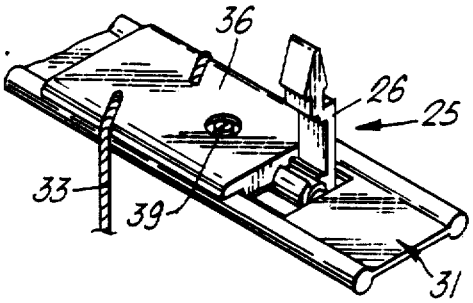
Figure 10:
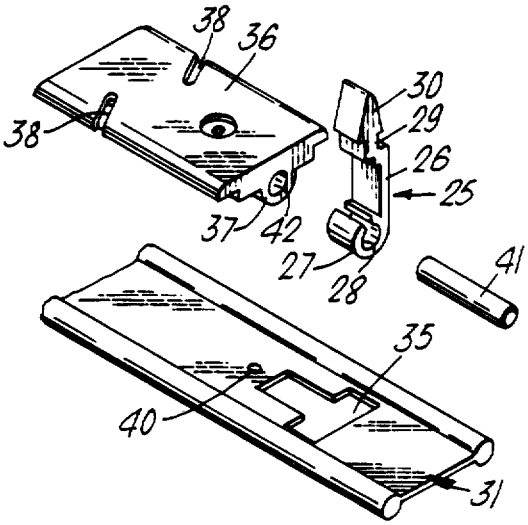

FIG. 7 includes an enlarged assembled view and an exploded view of the actuating member and a portion of the drive element actuated thereby;

FIG. 8 is an enlarged cross-section taken on the line VIII—VIII of FIG. 1 the blind in the opened position;

FIG. 9 is a fragmentary perspective view of a supporting member showing the upper end of a slat supporting means, a mounting clip and a securing plate;

FIG. 10 is an exploded view of the components of FIG. 9; and

Figure 11:
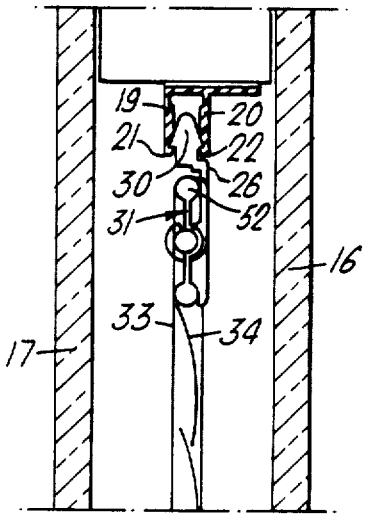

FIG. 11 is a view similar to the upper part of FIG. 8 showing the blind in the closed position.

FIG. 1 illustrates a double glazed window having a frame comprising two side frame members 10, 11 and upper and lower frame members 12 and 13. Secured to the upper and lower frame members are carriers 14 and 15 respectively. The frame members 11 to 13 carry outer and inner panes 16, 17.

Figure 2:
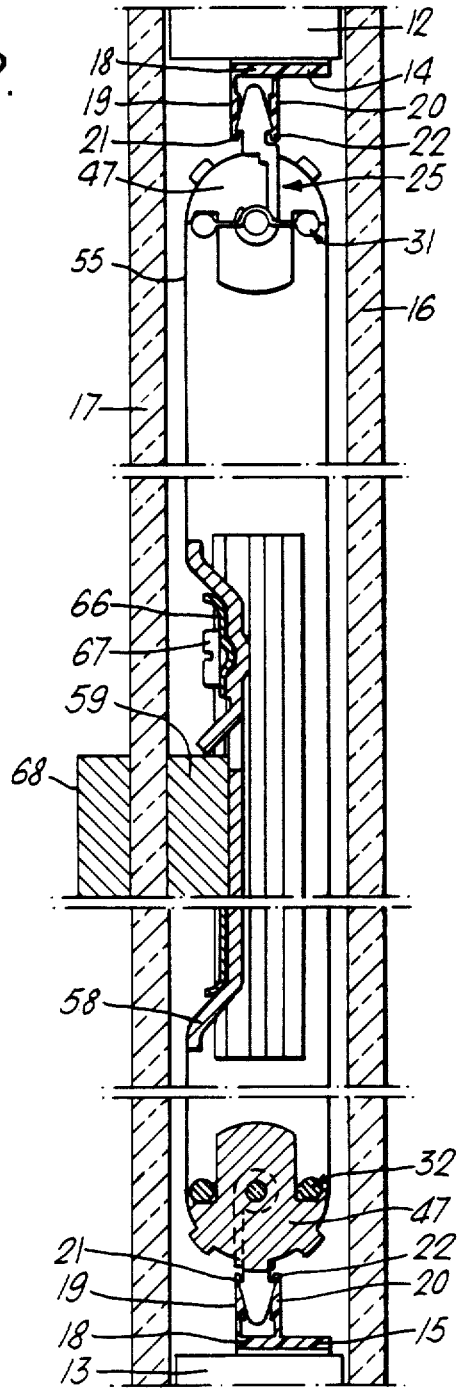
FIG. 2 is an enlarged section taken along the line II—II of FIG. 1.

It will noted from FIG. 2 that the carriers 14, 15 include a web 18 and two flanges 19, 20 which form with a part of the web a channel cross-section profile. The edges of the flanges 19, 20 are provided with inturned rims 21, 22.

Engaged into the channel sections of the carrier 14, 15 are pivotal securing elements indicated by the general reference numeral 25. They each consist of a hook-shaped body portion 26 (see FIGS. 3, 4, 9, 10 in particular) with a lower bearing portion 27 having a throughbore 28. Above the body is a neck 29 above which is an enlarged head 30. Referring again, for example, to FIG. 2, FIG. 8 or FIG. 11, it can be seen that the head 30 can be pressed up, as a pushed fit, between the flanges 19, 20, so that the rims 21, 22 engage under the head at the location of the neck 29 to hold the securing elements in the carriers 14, 15.

The blind includes an upper supporting member 31 and a lower supporting member 32 which are of a similar construction to a venetian blind slat, but rather more robust, having ribs 52 extending along each longitudinal edge.

Between these upper and lower supporting members extend slat supporting means in the form of ladder tapes 33 and on which are mounted conventional slats 34 (FIGS. 1, 8 and 11).

The upper and lower supporting members are carried by the securing elements 25 and for this purpose securing elements are provided in a number of places to be explained below. If reference is first made to FIG. 9, it will be seen that the upper support element 41 is provided with a T-shaped opening 35 into which the bearing portion 27 of the supporting element 25 can fit. Adjacent this is a plate 36 which is provided with a bearing boss 37 which can fit into the stem of the T-shaped opening 35. Slots 38 are formed in plate 36 and passing therethrough are the vertical parts of the ladder tape 33, which can be clamped against the upper supporting element 31 by passing a screw 39 downwardly through the plate and into a hole 40 (FIG. 10). Before this is done a bearing pin 41 is passed through the throughbore 28 and into an opening 42 in the bearing portion 37 of the plate 36. When this has been passed through the righthand end, as seen in FIGS. 9 and 10, the end of the bearing pin 41 abuts against the righthand end of the opening 35 and, as the screw 39 is tightened down, not only is the ladder tape secured, but also the bearing pin 41 is held in place. One then arrives at an assembly as shown in FIG. 9.

Figure 4:
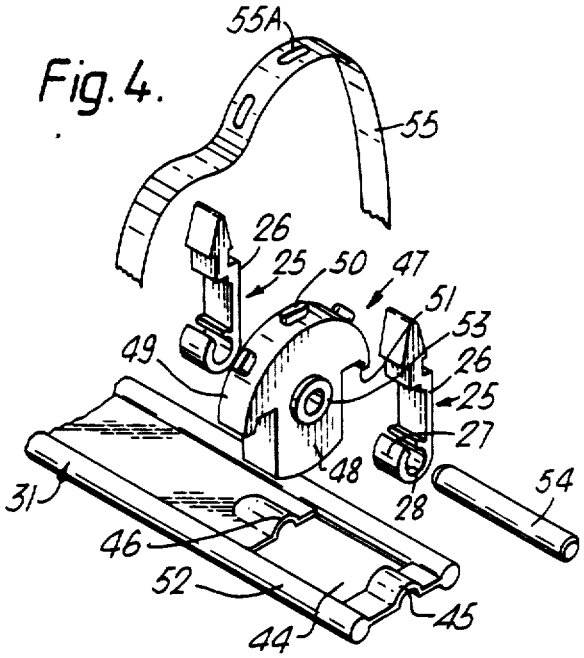
FIG. 4 is an exploded view of the parts of a supporting member, drive member and drive element of FIG. 3.
Figure 3:
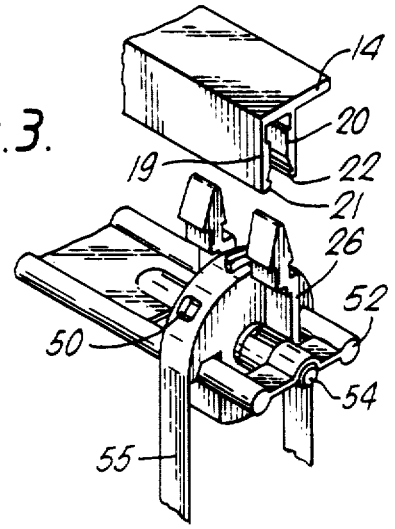
FIG. 3 is a perspective view of a drive member and drive element of the blind of FIG. 1 exploded away from a carrier for mounting an upper supporting member.

If reference is now made to FIGS. 2, 3 and 4 it will be seen that the upper supporting member 31 is provided with a further opening 44 and the portion of the upper supporting member 31 adjacent to the ends of this opening 44 are provided with bridge portions 45, 46. Into the opening 44 can be inserted, as shown in FIG. 4, two securing elements 25 and a drive member 47. This includes a main body 48 which can pass through the opening, and an upper part circular surface 49 which overhangs the body portion and carries a number (three as illustrated) of radially outwardly extending projections 50. The body 48 includes overhanging portions 51 which overhang the longitudinal ribs 52 on the upper supporting member 31 and the body also includes an internal hub 53 having a throughbore therein.

Another bearing pin 54, can be passed under the bridge 45 through the throughbores 28, 53 and under the bridge 46.

The position of the overhang 51 of the body 48 relative to the dimensions of the upper supporting member are such that when the parts are thus assembled, the assembled construction illustrated in FIG. 3 is held together as one.

The lower supporting member 32 is formed in exactly the same way together with securing elements 25, plates 36 and a drive member 47.

Passed over the part circular portion 49 of each drive member 47 is a flexible metal drive element 55 provided with apertures 55A to engage over the projections 50 to provide a positive drive connection between the drive element 55 and the drive members 47 (see FIG. 2). Referring to FIGS. 1 and 7, it will be seen that a channel section guide 56 is secured by screws 57 to the side frame member 10, the open side of the channel facing forwardly. Vertically slidable within this guide is an actuating member including a plate 58 and a magnet 59. The dimensions of the guide 56, the plate 58 and the magnet 59 are such that the front face of the magnet 59 abuts against the inner surface of the inner pane 17. The magnet is held on to the plate 59 by lugs 60 and the plate 58 is provided with sloping portions 61 and tongues 62. A clamping member 63 has a slot 64 to accept the tongue 62 and the end of the flexible drive element 55, as can be seen in the exploded view portion of FIG. 7. The whole assembly is retained together by a set screw 65 and the actual position of the driving element can be adjusted relative to the actuating member 58, 59 by sliding it more or less through the slot 64 prior to clamping.

If reference is now made to FIG. 1 it will be seen that five of the slats 34 are made shorter in the location of the guide 56. The length of the guide 56 is such as to span slightly greater than the pitch of these five slats and slightly less than the pitch above and below. Thus, in fact, the length of the guide 56 is approximately 5 slat pitches.

FIG. 2 illustrates a slightly different form of clamping of the end of the drive element 55 on to the actuating member 58, 59 in which an additional plate 66 is clamped against the face of the plate 58 by a screw 67.

With the blind made up to the extent of the provision of the upper and lower supporting members 32, the ladder tapes 33, the slats 34, drive members 47, and the supporting elements 25, the thus form assembly is inserted into a partly formed window and the supporting elements 25 are pushed upwardly into the upper carrier 14 and then downwardly into the lower carrier 15. The inner pane 17 is then located and one can provide an operating member 68 in the form of a further magnet in the inside of the pane.

Vertical movement of the operating element 68 will cause vertical movement of the actuating member 59 and thereby vertical movement directly to the flexible drive element 55 and thus positive tilting of both the upper and lower supporting members 31, 32. These supporting members then transmit this tilting motion to the ladder tapes and thereby cause opening and shutting of the blind from the position illustrated in FIG. 8 to the position illustrated in FIG. 11. It will be noted that the shaping of the body 26 of the securing clips 25 is such as to accommodate the rim 52 of the upper supporting member 31 in the closed position on the blind.

Figure 5:
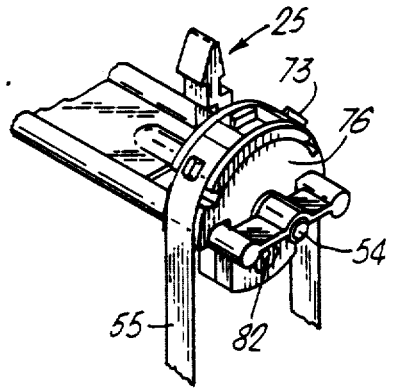
FIG. 5 is a view similar to FIG. 3 of an alternative embodiment.
Figure 6:
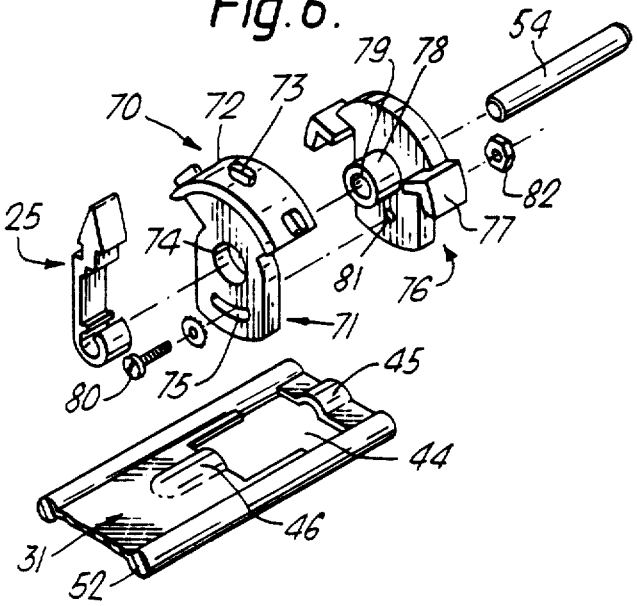
FIG. 6 is a perspective exploded view from the other side of the parts shown in FIG. 5.

Advantageously means are provided to adjust the position of at least one of the drive members relative to the supporting member by which it is carried. FIGS. 5 and 6 there illustrat an alternative form of the drive member. As seen in FIG. 6, the end portion of the supporting member 31 is exactly identical to that of FIG. 4. However, the drive element indicated by general reference 70 includes a first part 71 and a second part 76. The first part 71 has a part-circular surface 72 formed thereon having radially outwardly extending projections 73. A bore 74 passes through the first part 71 and formed below it is an arcuate slot 75. The second part 76 is of cooperating shape and includes overhangs 77 to fit over the beads 52 and the hub 78, having a throughbore 79, can be passed through the bore 74 in the first part. In order to hold the two parts together, a screw 80 passes through the arcuate slot 75, and through a hole 81 in the second part 76 and is held in place by a nut 82. It will be appreciated that the two parts can be rotated relative to one another about the axis of the pin 54 which passes through the throughbore 79. The actual relative position of the two parts can be fixed by tightening the nut 82 on the bolt 80.

What is claimed is:

1. A venetian blind mounted in the space between two panes of a multiple glazed window assembly, said window assembly including a frame for supporting said two panes, said blind comprising upper and lower elongate supporting members, having longitudinal axes, extending across at least part of the width of the blind, means for pivotably mounting said supporting members on the frame of the window assembly for rotation of said supporting members about their longitudinal axes, slat supporting means extending between and supported by said upper and lower supporting members, a plurality of slats carried by said slat supporting means, and operating means operable from outside of the window assembly, characterised in that the upper and lower supporting members are provided with respectively an upper and lower drive member, in that a flexible drive element, which is separate from said slat supporting means, is positively connected to said upper and lower drive members in a position to extend in the space between the panes of the window assembly, and in that operating means are operable on said flexible drive element to cause said upper and lower supporting members to be positively tilted together, without any slippage between said supporting members and said flexible drive element, thereby to cause tilting of said slats, so that tilting forces are transferred from the operating means to said upper and lower supporting members solely by said flexible drive element and said upper and lower drive members.

2. A blind according to claim 1, characterised in that the upper and lower drive members are provided with at least part-circular surfaces over which said flexible drive element passes and means are provided to positively engage the flexible drive element on said at least partly circular surfaces.

3. A blind according to claim 2, characterised in that the flexible drive element is in the form of a metal band passing over each at least partly circular surface, said surfaces and said band positively engaged by projections formed on one of said band and said surface which engage recesses defined by the other of said band and said surface.

4. A blind according to claim 1, 2 or 3, characterised in that at least one of the drive members is angularly adjustable with respect to its associated supporting member in a plane perpendicular to the longitudinal axis of the supporting member.

5. A blind according to claim 4, characterised in that at least one of the drive members is formed in two parts, a first part having said at least partly circular surface formed thereon and the second part being connected to the supporting member, the first part being circumferentially adjustable relative to the second part.

6. A blind according to any one of claims 1, 2 or 3, characterised in that the flexible drive element is connected to an actuating member located in the space between the panes of the window assembly, said actuating member carrying a magnet, whereby the actuating member can be moved by an operating member on the opposite side of the pane of glass by a further magnet.

7. A blind according to claim 6, characterised in that the actuating member is movable in a guide, mountable on the inside of a vertical part of the window frame, to control accurately the movement of the actuating member and said guide having means to hold the magnet carried thereby in contact with an adjacent pane.

8. A blind according to claim 6, characterised in that the flexible drive element is adjustably secured to the actuating member to enable the drive element to be mounted with a preselected tensioning force.

9. A blind according to any one of claims 1, 2 or 3, characterised in that the end of at least one slat supporting means is secured to a supporting member by a plate fixedly connected to that supporting member.

10. A blind according to claim 9, characterised in that adjacent each plate, the associated supporting member is provided with an opening, in that the means for pivotally mounting said associated supporting member, have a throughbore therein, and are pivotably mounted in said opening by way of a bearing pin passing through said throughbore and into an opening in said plate.

11. A blind according to claim 10, characterised in that the means for pivotably mounting at least one of the upper and lower supporting members, comprises bearing clips, said bearing clips each including a pivot bearing for the respective supporting member and securing element which is engageable by a snapfit connection in a receiving portion of a carrier on the respective frame portion of the window assembly.

12. A blind according to claim 11, characterised in that said carrier comprises an elongate profile of constant cross-section having a continuous receiving channel with at least one inturned rim and into which a head of said securing element may be pushed, the head of said securing element snapfitting behind said rims.

13. A blind according to any one of claims 1, 2 or 3, characterized in that at least one of the drive members is located in an additional opening at, or close to, one end of one of the supporting members and a bearing pin cooperates with the relevant supporting member body in pivotably holding said at least one of said drive members.

14. A blind according to claim 13 characterised in that at least one additional bearing clip, contributing to the pivotable mounting of one of the supporting members, is mounted at the location of the drive member.

15. A venetian blind mounted in the space between two panes of a multiple glazed window assembly, said window assembly including a frame for supporting said two panes, said blind comprising upper and lower elongate supporting members having longitudinal axes extending across at least part of the width of the blind, means for pivotally mounting said supporting members about their longitudinal axes on the frame of the window assembly, slat supporting means extending between and supported by said upper and lower supporting members, a plurality of slats carried by said slat supporting means and operating means operable from outside of the window assembly, characterised in that the means for pivotally mounting at least one of said upper and lower supporting members on the frame comprise bearing clips, each including a pivot bearing at a first end of said bearing clips for the respective supporting member, a flexible drive element, which is separate from said slat supporting means, is positively connected to said upper and lower drive members in a position to extend in the space between the panes of the window assembly, and a securing element at a second end of said bearing clips which is engageable by a snapfit connection in a receiving portion of a carrier on a respective frame portion of the window assembly.

16. A venetian blind according to claim 15, characterised in that said carrier comprises an elongate profile of constant cross-section, having a continuous receiving channel with at least one inturned rim into which said securing element may be pushed, with a body part on said securing element snapfitting behind said at least one rim.

17. A tilting support for a venetian blind having a plurality of horizontal spaced elongated slats positioned by a ladder cord extending vertically therebetween, said ladder cord having top and bottom ends, said slats being tiltable about their elongated axis in response to movement of said ladder cord, the support comprising:

(a) a substantially slat shaped upper supporting element;

(b) a bearing clip having first and second ends, the first end having means to attach the bearing clip to a window frame, the second end having means to tiltably mount said supporting elements;

(c) a body extending vertically between said first and second ends at a position to one side of a direct line between said first and second ends to define a space in a vertical direction from said second end between said first and second ends open at a side transverse to the elongated dimension of said supporting element so said supporting element may tilt about its elongated axis to a position with one side directly between said first and second ends without interference of said body.

18. A tilting support for a venetian blind assembly having a plurality of horizontal spaced elongated slats positioned by a ladder cord extending vertically therebetween, said ladder cord having top and bottom ends, said slats being tiltable about their elongated axis in response to movement of said ladder cord, the support comprising:

(a) a substantially slat shaped upper supporting element defining a pivot assembly opening;

(b) a bearing clip for holding said supporting element having means at first end for attaching said bearing clip to a window frame and a second end defining a transverse opening;

(c) a mounting element fixed on said supporting element having a portion extending through said pivot assembly opening defining a shaft opening parallel to the elongated axis of the supporting element; and a shaft having a first end received in said shaft opening, and a second end received in said transverse opening to rotatably mount said supporting element to said bearing clip, said shaft abutting a side of said pivot assembly opening to prevent motion of said shaft in one longitudinal direction.

* * * * *

UNITED STATES PATENT AND TRADEMARK OFFICE

CERTIFICATE OF CORRECTION

'ATENT NO. : 4,723,586

)ATED : February 9, 1988

NVENTOR(S) : Robbert E. Spangenberg

It is certified that error appears in the above-identified patent and that said Letters Patent is hereby :orrected as shown below:

Frontispiece at [73] Assignee: "Curacao, Netherlands"
should read -- Curacao, Netherlands Antilles --

Signed and Sealed this

Fifth Day of July, 1988

*Attest:*

DONALD J. QUIGG

*Attesting Officer*

*Commissioner of Patents and Trademarks*